US005828204A

United States Patent [19]

Jansen

[11] Patent Number: 5,828,204

[45] Date of Patent: Oct. 27, 1998

[54] POWER SUPPLY WITH MINIMAL DISSIPATION OUTPUT STAGE

[75] Inventor: Arian Jansen, Crolle, France

[73] Assignee: Hewlett-Packard Company, Palo Alto, Calif.

[21] Appl. No.: 675,302

[22] Filed: Jul. 1, 1996

[30] Foreign Application Priority Data

Jul. 14, 1995 [EP] European Pat. Off. ..... 95111027

[51] Int. Cl.[6] ..... H01F 5/00; H01F 7/08

[52] U.S. Cl. ..... 323/266; 323/274

[58] Field of Search ..... 323/274, 275, 323/280, 281, 284, 266

[56] References Cited

U.S. PATENT DOCUMENTS

| | | | |
|---|---|---|---|
| 4,479,085 | 10/1984 | Uchida et al. | 323/280 |
| 4,801,860 | 1/1989 | Murari et al. | 323/275 |
| 4,972,136 | 11/1990 | Banura | 323/275 |
| 4,983,905 | 1/1991 | Sano et al. | 323/274 |
| 5,079,455 | 1/1992 | McCafferty | 307/568 |
| 5,216,351 | 6/1993 | Shimoda | 323/224 |
| 5,307,257 | 4/1994 | Fukushima | 323/300 |
| 5,381,082 | 1/1995 | Schlicht | 323/280 |
| 5,396,412 | 3/1995 | Barlage | 323/282 |
| 5,563,498 | 10/1996 | Candy | 323/224 |
| 5,629,608 | 5/1997 | Budelman | 323/284 |
| 5,677,558 | 10/1997 | McGlinchey | 257/370 |

FOREIGN PATENT DOCUMENTS 0531945 3/1993 European Pat. Off. .

OTHER PUBLICATIONS

Michael Franke, "Zero–Drop–Spannungsregler" Radio Fernsehen Electronik, vol. 40, No. 7, p. 389, 1991.

James Wong, "Spannungsregler mit minimaler Verlustleistung" Electronik, vol. 40, No. 12, pp. 96, 98–102, 1991.

Electronic Design, vol. 42, No. 5, 7 Mar. 1994 Hasbrouck Heights, New Jersey US, pp. 45–49, Frank Goodenough 'Tiny IC Plus Fet Builds "Super LDO" Regulator'—*the whole document.

*Primary Examiner*—Peter S. Wong
*Assistant Examiner*—Bao Q. Vu

[57] ABSTRACT

An electrical power supply is provided with a regulation stage which on being supplied at its input with a dc input voltage with a significant ripple component ($V_{S1_OUT}$), outputs a dc output voltage ($V_{S2_OUT}$) at a level substantially equal to the dc input voltage value at the troughs of the input ripple component ($V_T$). As a result of this operation, the power dissipated in the stage is minimized. In order to regulate the dc output voltage ($V_{S2_OUT}$) to be at a particular level, this output voltage is compared to a reference to produce a control signal (S) that is fed back to an upstream regulation stage. This upstream stage then serves to vary the level of the trough voltage at the input of the downstream regulation stage.

16 Claims, 3 Drawing Sheets

POWER SUPPLY WITH MINIMAL DISSIPATION OUTPUT STAGE

BACKGROUND OF THE INVENTION

1. Field of the Invention

The present invention relates to power supplies.

2. Prior Art and Object of the Invention

In regulated power supplies for electronic equipment, the output regulation stage is generally supplied with a dc input voltage having a significant ripple component and it is the function of the output stage to produce a smoothed output at a voltage level set by a voltage reference (this voltage reference may either be explicit or implicit in the circuitry of the stage). The line voltage drop across the main regulation stage, and thus the power dissipated in the stage, depends on the difference between the voltage reference and the instantaneous input voltage. This power dissipation can be substantial.

It is an object of the present invention to provide an arrangement permitting the power dissipation in an output regulation stage of a power supply to be minimised.

SUMMARY OF THE INVENTION

According to one aspect of the present invention, there is provided an electrical power supply comprising a regulation stage having an input and an output, the regulation stage on being supplied at its input with a dc input voltage with a significant ripple component, being operative to provide at its output a dc output voltage at a level substantially equal to the dc input voltage value at the troughs of the ripple component.

In this way, the power dissipated in the stage is minimised. Of course, it will generally be required to regulate the dc output voltage to be at a particular level. To achieve this, the output voltage is compared to a reference to produce a control signal that is fed back to an upstream regulation stage, this upstream stage serving to vary the level of the trough voltage at the input of the downstream regulation stage.

The regulation stage that regulates its output to the trough voltage at its input, preferably comprises:

minimum voltage detector for deriving and storing a minimum voltage measure indicative of a minimum of the dc input voltage, an active regulation device having a regulation path connected in series between the input and output of the regulation stage, the active regulation device being controllable to regulate the voltage drop across its regulation path, and control means responsive to the minimum voltage measure stored by the minimum voltage detector to control the active, regulation device such that the voltage drop across its regulation path substantially corresponds to the difference between the instantaneous value of the dc input voltage and the minimum of the dc input voltage as indicated by the minimum voltage measure.

Advantageously, the minimum voltage detector is connected to receive the dc output voltage and is operative to store a measure of a minimum of that voltage as the minimum voltage measure, the control means being operative to cause the active regulation device to have minimal voltage drop across its regulation path during periods when the input voltage is near its minimum.

In a preferred embodiment of the invention, the minimum voltage detector and the control means jointly comprise:

a capacitor connected in series with a resistor across the output of the regulation stage, the voltage across the capacitor serving as the minimum voltage measure and the voltage level at the junction of the capacitor and resistor (herein the junction voltage level) being indicative of the difference between the output voltage and the minimum voltage represented by the minimum voltage measure;

comparison means having an output and being responsive to the magnitude of the junction voltage level relative to a reference, to generate at its output the control signal such that:

as the junction voltage level seeks to rise above said reference, the voltage drop across the regulation path of the active regulation device increases, and as the junction voltage level seeks to fall below said reference, the active regulation device is turned fully on to minimise the voltage drop across its regulation path; and discharge means controlled by the comparison means to open a discharge path for the capacitor during periods when the junction voltage level seeks to fall below said reference whereby to permit the capacitor voltage to follow down the output voltage.

Advantageously, a zener diode is connected between the capacitor/resistor junction and the output of the comparison means, and the comparison means is operative when the junction voltage level seeks to fall below said reference to raise the level of the control signal until the zener diode conducts; in this arrangement, the zener diode serves as the discharge means and ensures a level of the control signal sufficient to cause the active regulation device to be fully on during periods when the junction voltage level seeks to fall below said reference.

According to another aspect of the present invention, there is provided an electrical power supply comprising:

a first regulation stage for producing in output an intermediate dc voltage with a significant ripple component, said first regulation stage being responsive to a control input fed thereto to vary the mean value of the intermediate dc voltage thereby to cause the level of the troughs of the ripple component to change, a second regulation stage having an input and an output, the second regulation stage being connected to receive at its input the aforesaid intermediate dc voltage output by the first regulation stage and being operative to provide at its output a dc output voltage at a level having a fixed relation to the value of said intermediate dc voltage at the troughs of said ripple component, and loop control means for comparing said dc output voltage produced by the second regulation stage with a reference, and for generating said control input such that the first regulation stage adjusts its mean value to a level causing said dc output voltage to settle at a level set by said reference.

BRIEF DESCRIPTION OF THE DRAWINGS

A power supply unit embodying the invention will now be described, by way of non-limiting example, with reference to the accompanying diagrammatic drawings, in which.

BEST MODE OF CARRYING OUT THE INVENTION

Figure 1A:
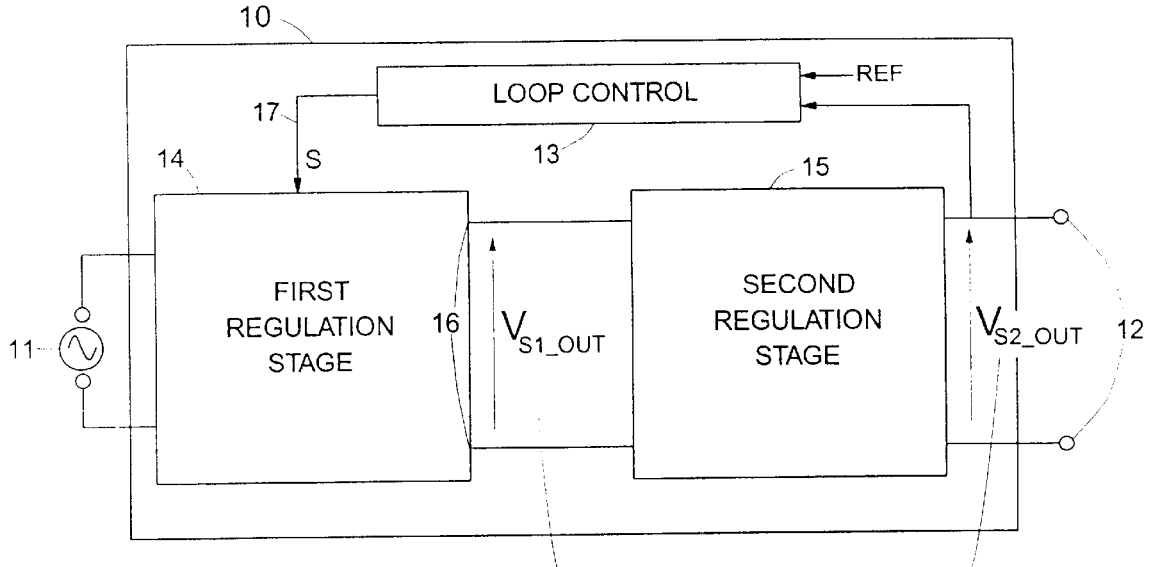
FIG. 1A is a block diagram of the power supply unit.

FIG. 1A shows a power supply unit 10 connected on its input side to an ac.power source 11 and operative to output a regulated d.c. voltage at output terminals 12.

The power supply unit comprises a first regulation stage 14, a second regulation stage 15, and a loop control block 13.

Figure 1B:
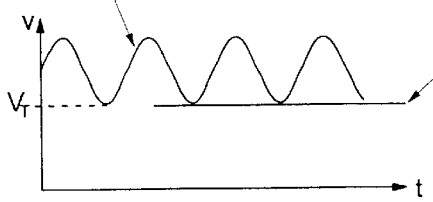
FIG. 1B is a voltage/time plot showing voltages existing at various points of the power supply unit.

The first regulation stage 14 is connected on its input side to the ac source 11 and produces at its output 16 an intermediate d.c voltage $V_{S1_OUT}$ that has a significant ripple component (see FIG. 1B). The mean d.c. voltage level of this intermediate voltage is controlled by a control signal S fed to the first stage 14 from the loop control block 13 on line 17.

The first regulation stage 14 is, for example, a switched-mode power supply with power factor correction, the control signal S serving to control the duty cycle of the switching device. Such a power supply stage is well known to persons skilled in the art and will therefore not be described in further detail herein.

The second regulation stage receives as input the intermediate voltage $V_{S1_OUT}$ and produces at the output terminals 12 a smoothed d.c. voltage $V_{S2_OUT}$. The level of this voltage $V_{S2_OUT}$ substantially corresponds to the value $V_T$ of the intermediate voltage $V_{S1_OUT}$ at the troughs of the ripple component of this voltage (see FIG. 1B).

To control the level of the output voltage $V_{S2_OUT}$ this voltage is fed back to the loop control block 13 to which also supplied a reference representative of the desired output voltage level at terminals 12. The loop control block 13 compares the fed-back voltage $V_{S2_OUT}$ with the reference and sets the control signal S accordingly to effect any needed adjustment in the mean value of the intermediate voltage $V_{S1_OUT}$ produced by the first regulation stage 14. Adjustment of this mean level will vary the trough voltage $V_T$ of the intermediate voltage $V_{S1_OUT}$ which in turn will vary the output voltage $V_{S2_OUT}$ (since, as noted above, the second regulation stage causes the voltage $V_{S2_OUT}$ to follow the trough voltage level $V_T$ of the intermediate voltage $V_{S1_OUT}$).

Figure 2A:
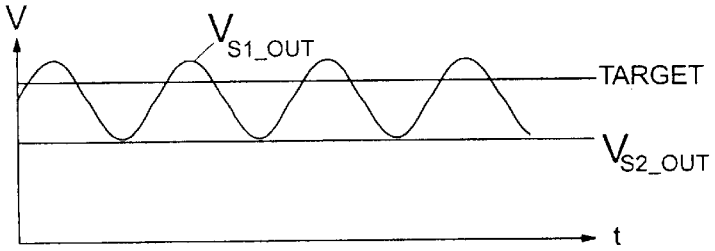
FIG. 2A is a voltage/time plot showing the relation between input, output and target voltages of an output regulation stage of the FIG. 1 power supply unit, in the case where the output voltage is too low.

FIG. 2A illustrates the situation where the output voltage $V_{S2_OUT}$ is below the target voltage TARGET represented by the reference fed to the loop control block 13. In this case the loop control block 13 sets the control signal in dependance on the difference between TARGET and $V_{S2_OUT}$ to cause the first stage to increase the mean value of the intermediate voltage $V_{S1_OUT}$.

Figure 2B:
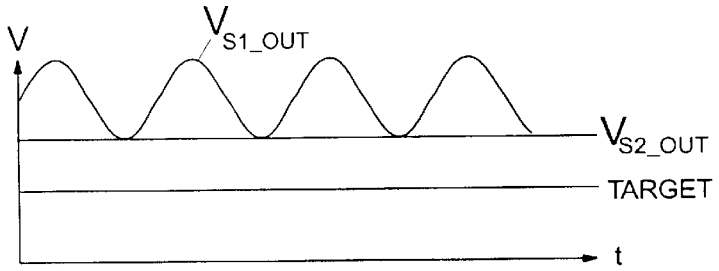
FIG. 2B is a voltage/time plot showing the relation between input, output and target voltages of the output regulation stage of the FIG. 1 power supply unit, in the case where the output voltage is too high.

FIG. 2B illustrates the situation where the output voltage $V_{S2_OUT}$ is above the target voltage TARGET represented by the reference fed to the loop control block 13. In this case the loop control block 13 sets the control signal in dependance on the difference between TARGET and $V_{S2_OUT}$ to cause the first stage to decrease the mean value of the intermediate voltage $V_{S1_OUT}$.

Details of the loop control block 13 are not given herein as it will be readily apparent to persons skilled in the art how block 13 may be implemented. It will, of course, be appreciated that the reference need not take the form of an explicit input to the control block but may be determined by the components of the block 13 itself.

Figure 3:
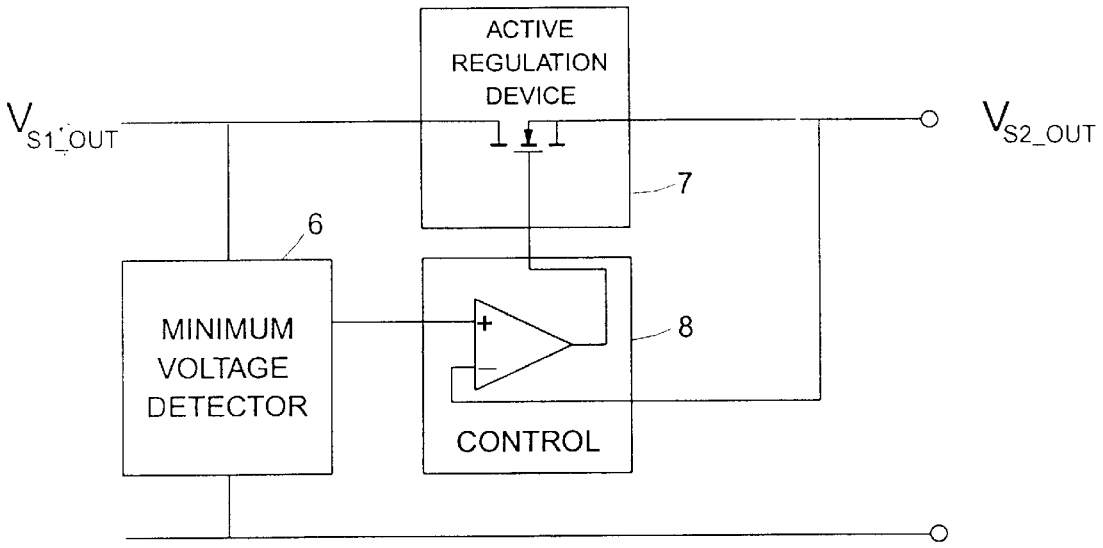
FIG. 3 is a block diagram showing the main functional components of the output regulation stage of the FIG. 1 power supply unit.

FIG. 3 is a block diagram showing the main functional blocks of the second regulation stage 15. These functional blocks are a minimum voltage detector 6 for capturing a measure of the minimum of the input voltage $V_{S1_OUT}$ to the second stage, an active regulation device 7 connected in series between the input and output of the second stage, and a control block 8 for controlling the active regulation device in dependence on the difference between the minimum voltage measure captured by the minimum voltage detector 6 and a measure of the output voltage $V_{S2_OUT}$. By way of non-limiting illustration, the control block 8 is depicted as an error op amp and the active regulation device 7 as a MOSFET. The control block 8 on sensing movement of the output voltage $V_{S2_OUT}$ above the captured minimum voltage, controls the active regulation device 7 to increase the voltage drop across the device 7 and so bring the output voltage back down towards the minimum voltage captured by detector 6.

The measures of the minimum voltage and of the output voltage $V_{S2_OUT}$ can take any form provided they serve to indicate the values of the measured voltages.

Figure 4:
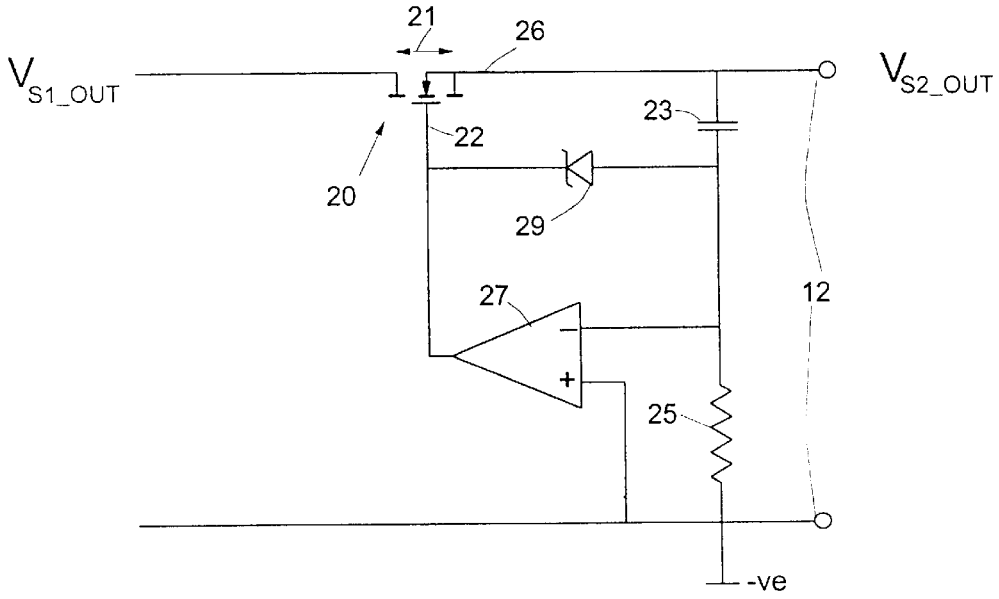
FIG. 4 is a circuit diagram of an embodiment of the FIG. 3 block diagram.

FIG. 4 shows a simplified version of a preferred embodiment of the second stage 15. In this case, a MOSFET 20 forms the active regulation device 7 of FIG. 3 whilst an error amp 27 and a capacitor 23 form the main components of the control block 8 and the minimum voltage detector 6 respectively. In fact, as will become clearer below, the functions of the control block 8 and minimum voltage detector are to a degree merged in the FIG. 4 circuit. With regard to detection of the minimum of the input voltage $V_{S1_OUT}$, in the FIG. 4 circuit this is done by monitoring the output voltage $V_{S2_OUT}$ rather than in the voltage $V_{S1_OUT}$. This is possible because, as will be more fully explained below, the MOSFET 20 is put into its fully on state with minimal voltage drop across its drain-source regulation path 21 when the output voltage is near its minimum and this results in the minimum of the input voltage $V_{S1_OUT}$ being passed through to the output where it is captured by the minimum voltage detector.

As already noted, the minimum voltage detector comprises the capacitor 23 which in the FIG. 4 is connected in series with a resistor 25 between the positive output line 26 and a negative bias voltage. In this embodiment, the capacitor 23 is arranged to capture and store a voltage equal to the minimum voltage appearing on the positive output line 26. The voltage at the junction of capacitor 23 and resistor 25 then corresponds to the difference between the captured minimum voltage and the actual voltage on the positive output line 26; this voltage should ideally be zero volts and for the major part of the cycle of the ripple wareform on the input voltage $V_{S1_OUT}$, it is the job of the op amp 27 to adjust the voltage on the gate 22 of the MOSFET 20 to so regulate the voltage drop across the drain-source regulation path 21, that the voltage at the junction of capacitor 23 and resistor 25 is brought back to zero. In other words, as the voltage on the positive output line 26 seeks to follow the input voltage ripple and rise above the input voltage minimum, the voltage at the junction of capacitor 23 and resistor 25 will also try to rise, immediately causing a decrease in gate voltage. This results in an increase in the drain-source voltage drop across the MOSFET with the consequence that the voltage $V_{S2_OUT}$ on line 26 is held down towards the minimum voltage held by capacitor 23.

This regulation of $V_{S2_OUT}$ continues for the majority of each cycle of the input ripple waveform, that is, for the portion of the cycle for which the voltage on line 26 is seeking to move above the captured minimum voltage. During this cycle portion, the capacitor voltage will increase slightly as the capacitor 23 charges up slowly.

As the input voltage, in following its ripple component, approaches its minimum, there comes a stage when the voltage on line 26 starts to fall below the voltage held on capacitor 23 thereby causing the voltage at the junction of capacitor 23 and resistor 23 to move below zero. As a result, the op amp drives the MOSFET gate voltage high resulting in the MOSFET being fully on thereby ensuring that the minimum of the input voltage $V_{S1_OUT}$ is passed through to line 26. The output level of the op amp during this period is set by a zener diode 29 that is connected between the junction of the capacitor 23 and resistor 25 and the op amp output—the level of the op amp output rises until the zener diode 29 conducts to bring the voltage at the junction of capacitor 23 and resistor 25 back up to zero. The value of the zener diode 29 is chosen such that the gate voltage of MOSFET is sufficiently high to ensure that MOSFET is fully on.

Conduction of the zener diode 29 also ensures that the capacitor 23 can readily discharge so that the voltage across it will follow down the voltage on line 26 to the minimum of the input voltage as passed through MOSFET 20.

When the input voltage $V_{S1_OUT}$ starts to move up again, taking with it the voltage on line 26, the voltage at the junction of capacitor 23 and resistor 26 starts to go positive which results in the MOSFET being once again regulated by op amp 27 to keep the voltage $V_{S2_OUT}$ on line 26 approximately equal to the voltage across capacitor 23. Operation of the FIG. 4 circuit then continues in the manner already described.

Figure 5:
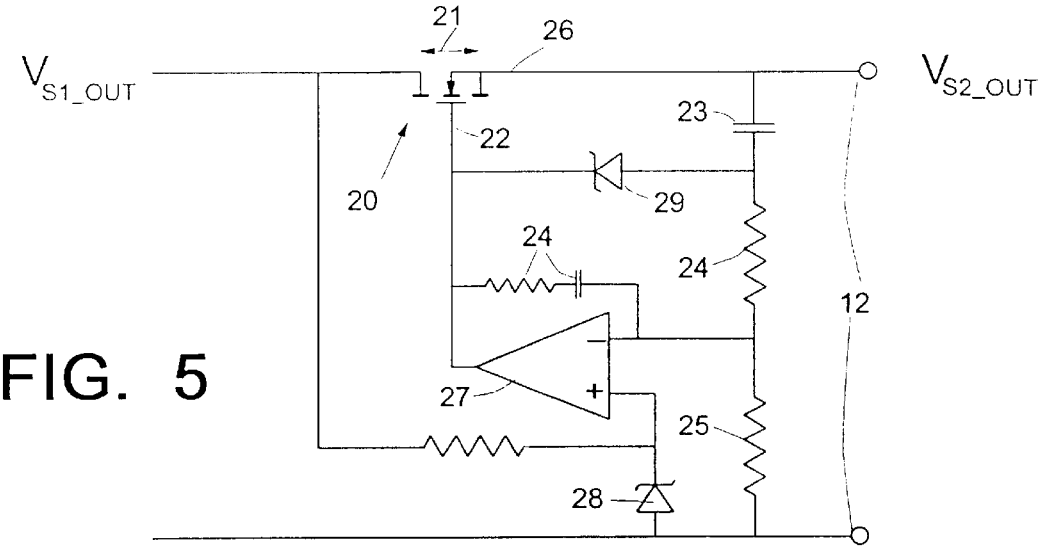
FIG. 5 is a circuit diagram of a more practical form of the FIG. 4 circuit.

FIG. 5 shows a more practical form of the FIG. 4 circuit. In this case, the need for a negative bias voltage has been avoided by applying a positive reference voltage (provided by zener diode 28) to the non-inverting input of op amp 27. A consequence of this is that the voltage captured across the capacitor 23, whilst still being a measure of the minimum voltage of the input $V_{S1_OUT}$, is not equal to that voltage (being instead that voltage reduced by the reference voltage value of zener 28). Also in the FIG. 5 circuit, components 24 have been added for stability reasons as will be appreciated by persons skilled in the art.

Figure 6:
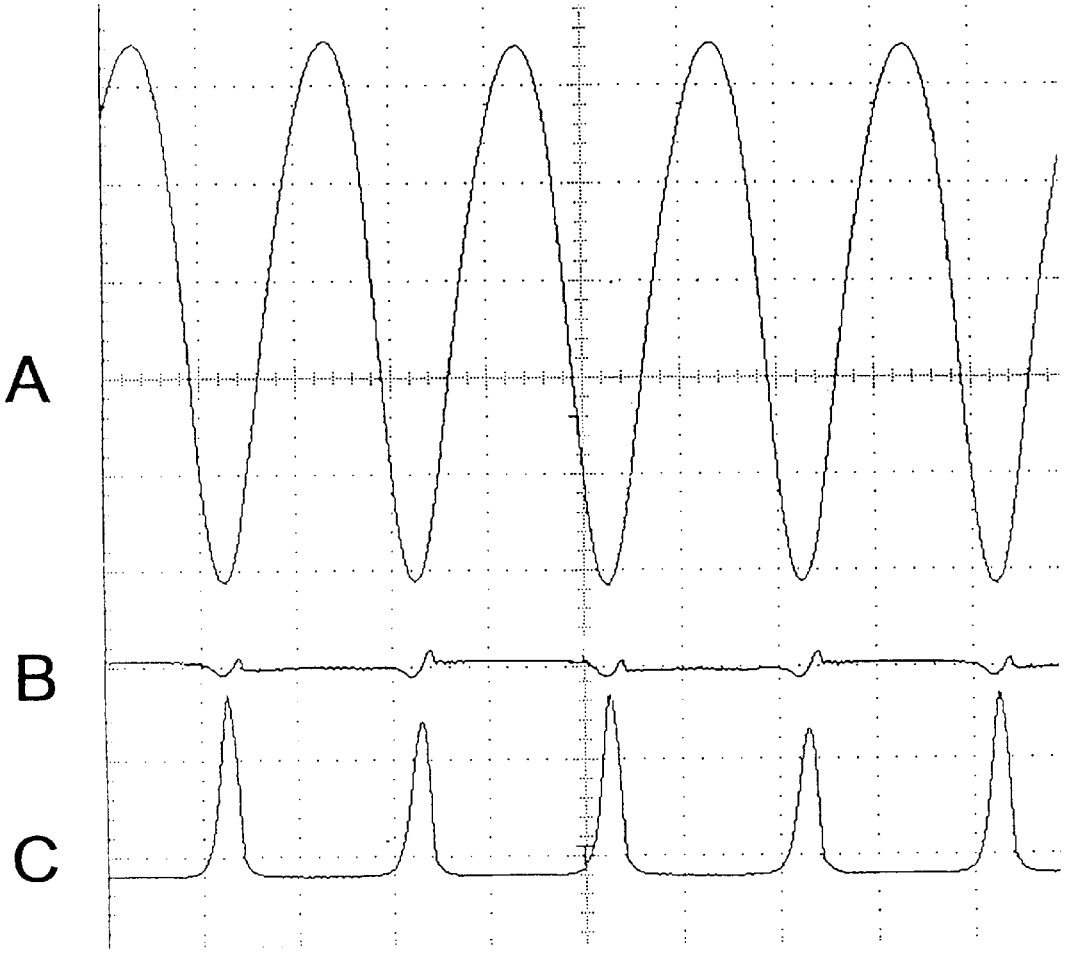
FIG. 6 are voltage/time plots for the FIG. 5 circuit.

FIG. 6 illustrates typical voltage/time wareform traces for the FIG. 5 circuit. The upper trace A shows the ripple component of the second-stage input voltage $V_{S1_OUT}$. The middle trace B shows on the same scale as trace A, the second-stage output voltage $V_{S2_OUT}$. The perturbations in $V_{S2_OUT}$ correspond to the period when MOSFET is fully on. The lower trace C, which is to a different scale to traces A and B, shows the voltage applied to the gate 22 of the MOSFET, the peaks of this trace corresponding to the fully-on periods of the MOSFET.

It will be appreciated that many variants of the second regulation stage are possible. For example, one possible implementation (though not preferred) of the minimum voltage detector would be to rapidly sample the voltages $V_{S1_OUT}$, $V_{S2_OUT}$ and produce digital measures for processing by a separate processor to generate a control signal for the active regulation device. Furthermore, the active regulation device can be a bipolar power transistor rather than a MOSFET and a controllable zener diode could be used in FIG. 5 to replace the zener 28 and op amp 27.

Although in the above-described example the second stage 15 maintains its output voltage substantially at the level of the trough voltage $V_T$, it would also be possible to arrange for the output voltage to be in some fixed relationship to the trough voltage (for example, one volt less). However, it is preferred that this fixed relationship is substantially one of equality as this minimises the power dissipation in the second regulation stage 15.

Whilst the ripple component of the input voltage $V_{S1_OUT}$ to the second stage has been shown as sinusoidal, it will be appreciated that this ripple component may have a different time-varying form.

I claim:

1. An electrical power supply comprising a regulation stage having an input and an output, the regulation stage being supplied at its input with a dc input voltage with a significant ripple component, the regulation stage including means to provide at its output an output voltage at a level essentially equal to the input voltage value occurring at troughs of the ripple component.

2. An electrical power supply according to claim 1, wherein the regulation stage comprises:

a minimum voltage detector including means for deriving and storing a minimum voltage measure indicative of said input voltage occurring at troughs thereof, an active regulation device having a regulation path connected in series between the input and output of the regulation stage, the active regulation device being controllable to regulate the voltage drop across the regulation path, and control means responsive to the minimum voltage measure stored by the minimum voltage detector to control the active regulation device such that the voltage drop across the regulation path is maintained essentially equal to the input voltage reduced by the minimum voltage measure.

3. An electrical power supply according to claim 2, wherein the control means causes the active regulation device to have minimal voltage drop across the regulation path during troughs of the input voltage, such that the output voltage is essentially equal to the input voltage during troughs of the input voltage, and wherein the minimum voltage detector stores a measure of the output voltage during troughs of the input as the minimum voltage measure.

4. An electrical power supply according to claim 3, wherein said minimum voltage detector and said control means jointly comprise:

a capacitor connected in series with a resistor across the output voltage, said minimum voltage measure being stored across said capacitor such that a voltage level at the junction of the capacitor and resistor is a junction voltage level which indicates any difference between the output voltage and said minimum voltage measure;

comparison means having an output and being responsive to differences between said junction voltage level and a reference, to generate at its output said control signal such that:

as the junction voltage level seeks to rise above said reference, the regulation path voltage drop increases, and as the junction voltage level seeks to fall below said reference, the active regulation device is turned fully on to minimise the regulation path voltage drop; and discharge means controlled by the comparison means to open a discharge path for the capacitor during periods when the junction voltage level seeks to fall below said reference, thus permitting said minimum voltage measure to follow down said output voltage.

5. An electrical power supply according to claim 4, wherein a zener diode is connected between the capacitor/resistor junction and the output of the comparison means, the comparison means being operative when the junction voltage level seeks to fall below said reference to raise the level of said control signal until the zener diode conducts, the zener diode serving as said discharge means and ensuring a level of said control signal sufficient to cause the active regulation device to be fully on during periods when the junction voltage level seeks to fall below said reference.

6. An electrical power supply according to claim 1, in which said regulation stage constitutes a downstream regulation stage of the power supply, the power supply further comprising: 12 an upstream regulation stage for producing in output an intermediate dc voltage with a significant ripple component, this intermediate dc voltage being fed to the input of the downstream regulation stage to provide the dc input voltage of that stage, the upstream regulation stage being responsive to a control input fed thereto to vary the mean value of said intermediate dc voltage whereby to vary the level of the troughs of the ripple component of the intermediate dc voltage, and loop control means for comparing said dc output voltage produced by said downstream regulation stage with a reference, and for generating said control input such that said upstream regulation stage adjusts its mean value to a level causing said dc output voltage to settle at a level set by said reference.

7. An electrical power supply comprising:

a first regulation stage for producing in output an intermediate dc voltage with a significant ripple component, said first regulation stage being responsive to a control input fed thereto to vary the mean value of said intermediate dc voltage thereby to cause the level of the troughs of said ripple component to change, a second regulation stage having an input and an output, the second regulation stage being connected to receive at its input said intermediate dc voltage output by the first regulation stage and being operative to provide at its output a dc output voltage at a level having a fixed relation to the value of said intermediate dc voltage at the troughs of said ripple component, and loop control means for comparing said dc output voltage produced by said second regulation stage with a reference, and for generating said control input such that said first regulation stage adjusts its mean value to a level causing said dc output voltage to settle at a level set by said reference.

8. An electrical power supply according to claim 2, in which said regulation stage constitutes a downstream regulation stage of the power supply, the power supply further comprising:

an upstream regulation stage for producing in output an intermediate dc voltage with a significant ripple component, this intermediate dc voltage being fed to the input of the downstream regulation stage to provide the dc input voltage of that stage, the upstream regulation stage being responsive to a control input fed thereto to vary the mean value of said intermediate dc voltage whereby to vary the level of the troughs of the ripple component of the intermediate dc voltage, and loop control means for comparing said dc output voltage produced by said downstream regulation stage with a reference, and for generating said control input such that said upstream regulation stage adjusts its mean value to a level causing said dc output voltage to settle at a level set by said reference.

9. An electrical power supply according to claim 3, in which said regulation stage constitutes a downstream regulation stage of the power supply, the power supply further comprising:

an upstream regulation stage for producing in output an intermediate dc voltage with a significant ripple component, this intermediate dc voltage being fed to the input of the downstream regulation stage to provide the dc input voltage of that stage, the upstream regulation stage being responsive to a control input fed thereto to vary the mean value of said intermediate dc voltage whereby to vary the level of the troughs of the ripple component of the intermediate dc voltage, and loop control means for comparing said dc output voltage produced by said downstream regulation stage with a reference, and for generating said control input such that said upstream regulation stage adjusts its mean value to a level causing said dc output voltage to settle at a level set by said reference.

10. An electrical power supply according to claim 4, in which said regulation stage constitutes a downstream regulation stage of the power supply, the power supply further comprising:

an upstream regulation stage for producing in output an intermediate dc voltage with a significant ripple component, this intermediate dc voltage being fed to the input of the downstream regulation stage to provide the dc input voltage of that stage, the upstream regulation stage being responsive to a control input fed thereto to vary the mean value of said intermediate dc voltage whereby to vary the level of the troughs of the ripple component of the intermediate dc voltage, and loop control means for comparing said dc output voltage produced by said downstream regulation stage with a reference, and for generating said control input such that said upstream regulation stage adjusts its mean value to a level causing said dc output voltage to settle at a level set by said reference.

11. An electrical power supply according to claim 5, in which said regulation stage constitutes a downstream regulation stage of the power supply, the power supply further comprising:

an upstream regulation stage for producing in output an intermediate dc voltage with a significant ripple component, this intermediate dc voltage being fed to the input of the downstream regulation stage to provide the dc input voltage of that stage, the upstream regulation stage being responsive to a control input fed thereto to vary the mean value of said intermediate dc voltage whereby to vary the level of the troughs of the ripple component of the intermediate dc voltage, and loop control means for comparing said dc output voltage produced by said downstream regulation stage with a reference, and for generating said control input such that said upstream regulation stage adjusts its mean value to a level causing said dc output voltage to settle at a level set by said reference.

12. A method of regulating a dc input voltage, the dc input voltage having a significant ripple component wherein minimum input voltage values are trough values which occur during troughs of the input voltage, said method comprising the steps of:

detecting the trough values; and providing an output voltage essentially equal to the trough values offset by a constant value.

13. A method of regulating a dc input voltage according to claim 12, wherein the constant value of the offset is zero.

14. A method of regulating a dc input voltage according to claim 12, further comprising the steps of:

storing the trough values as a minimum voltage measure; and producing a voltage drop across a regulation path defined between the input voltage and the output voltage, said voltage drop bearing an essentially constant relationship to a difference between the input voltage and the minimum voltage measure;

such that the output voltage bears an essentially constant relationship to the minimum voltage measure.

15. A method of regulating a dc input voltage according to claim 14 wherein the voltage drop across the regulation path is essentially equal to the difference between the input voltage and the minimum voltage measure, wherefor the output voltage is essentially equal to the minimum voltage measure.

16. A method of regulating a dc input voltage according to claim 14, further comprising the step of:

reducing the voltage drop across the regulation path to a minimum value during troughs of the input voltage such that the output voltage equals the input voltage less the minimum value of the regulation path during troughs of the input voltage;

and wherein the step of detecting the trough value includes a step of detecting a value of the output voltage during troughs of the input voltage, and the step of storing the trough values as a minimum voltage measure includes storing the value of the output voltage during troughs of the input voltage as a minimum voltage measure.

* * * * *